United States Patent [19]

Berrange

[11] 4,422,795

[45] Dec. 27, 1983

[54] COMPACTOR

[76] Inventor: Aubrey R. Berrange, 011 Nahoon, Leicester Rd., Bedfordview, Johannesburg, Transvaal, South Africa

[21] Appl. No.: 138,378

[22] Filed: Apr. 8, 1980

[30] Foreign Application Priority Data

Apr. 9, 1979 [ZA] South Africa ..... 79/1666
Jun. 12, 1979 [ZA] South Africa ..... 79/6616

[51] Int. Cl.[3] ..... E01C 19/26
[52] U.S. Cl. ..... 404/124; 301/1
[58] Field of Search ..... 301/131–132, 301/124.4, 126, 9 DN, 114, 1, 6 WB, 135, 40; 404/122–124, 132, 85; 180/20; 159/49

[56] References Cited

U.S. PATENT DOCUMENTS

| | | | |
|---|---|---|---|
| 586,909 | 7/1897 | Miller | 404/122 |
| 590,138 | 9/1897 | Deweese | 404/132 |
| 827,587 | 7/1906 | Warner | 404/124 X |
| 1,010,260 | 11/1911 | Hill | 404/122 X |
| 1,206,895 | 12/1916 | Nilson | 404/122 X |
| 1,302,275 | 4/1919 | Ashmore et al. | 404/124 |
| 1,402,069 | 1/1922 | Hoard | 301/114 X |
| 1,693,903 | 12/1928 | Johnston | 404/72 |
| 1,748,198 | 2/1930 | Van Wormer | 301/1 |
| 2,052,524 | 8/1936 | Baker | 301/1 X |
| 2,314,601 | 3/1943 | Ritchie | 301/9 DN X |
| 2,532,605 | 12/1950 | Castleberry | 301/1 |
| 2,858,163 | 10/1958 | Nagel | 301/1 |
| 3,052,167 | 9/1962 | Beale | 404/85 |
| 3,161,418 | 12/1964 | Brennan et al. | 301/1 X |
| 3,724,342 | 4/1973 | Caron et al. | 404/128 X |
| 3,950,110 | 4/1976 | Clifford | 404/124 |
| 3,966,346 | 6/1976 | Berrange | 404/124 |
| 3,993,356 | 11/1976 | Groff et al. | 301/6 |
| 4,147,448 | 4/1979 | Jeffery | 404/124 |

FOREIGN PATENT DOCUMENTS

| | | | |
|---|---|---|---|
| 1534363 | 8/1969 | Fed. Rep. of Germany | 404/127 |
| 2119332 | 12/1972 | Fed. Rep. of Germany | 404/127 |

*Primary Examiner*—Nile C. Byers, Jr.
*Attorney, Agent, or Firm*—Ladas & Parry

[57] ABSTRACT

A compactor which includes two laterally spaced impact rollers on an axle which constrains the rollers to rotate in synchronism. The axle includes a first component which transmits bending moments, and a second component which transfers torsional forces, between the rollers.

The spaced impact rollers make it possible to compact embankment edges and increase the stability of the compactor.

14 Claims, 5 Drawing Figures

COMPACTOR

BACKGROUND OF THE INVENTION

THIS invention relates to a compactor which is based on the use of impact rollers.

The term "impact roller" was used by the applicant in 1953 in U.S. Pat. No. 2,909,106 and in equivalent patent applications in other countries to describe an impact mass of non-circular profile which when towed over a surface by means of an appropriately constructed drawbar and tractive vehicle produces a series of impact blows. The shaped mass i.e. the roller, in all developments of which the applicant is aware, is relatively narrow, of the order of 1½ meters wide, and is surrounded by the frame of the drawbar.

The relatively narrow impact roller of the type described has the particular disadvantage that it is considerably narrower than the track width of the towing vehicle and consequently it cannot compact the full width traversed by the vehicle. Consequently when work is done on earth embankments a zone of uncompacted soil which is usually more than a meter wide is left along the embankment edge. This soil must then be compacted by other means.

SUMMARY OF THE INVENTION

It is an object of the present invention to provide a compactor which enables this disadvantage to be remedied.

The invention provides a compactor which comprises axle means and at least two laterally separated impact rollers which are secured to the axle means. To ensure that the compactor operates smoothly the impact rollers have substantially identical profiles and are constrained to rotate substantially in synchronism with one another but are permitted limited resilient movement out of synchronism when torsional forces exist, for example when the compactor turns or slews. For these purposes the compactor includes resilient means to transmit torsional forces between the separated impact rollers. Further, because large bending forces are imposed by the impact rollers on the axle means, resilient means permitting a degree of tilting are interposed between each impact roller and the axle means.

The axle means may comprise, for each impact roller, a bearing mounted in a supporting structure and the end of a shaft which is rotatably supported by the bearing means. The two impact rollers are secured to the opposed ends of the same shaft. This type of construction demands of the shaft that it must be capable of transmitting the torsional forces between the two impact rollers, and also other forces.

The invention however extends to an alternative design which avoids the high shaft stresses. Thus the axle means may include two stub axles each fitted with a bearing which rotatably supports an impact roller. Means is provided which resiliently interconnects the two impact rollers and which constrains the impact rollers to rotate substantially in synchronism with one another, but permits a degree of non-synchronism in response to torsional forces. With this design the stub axles carry the bending moments and the constraining means transmits torsional forces between the two impact rollers.

Each stub axle may be formed by a tubular member and a bearing which rotatably supports the impact roller. The constraining means may comprise a shaft (functioning as a torsion bar) which is rotatably located in the bores of the tubular members with the two impact rollers being secured to the opposed ends of the shaft.

The compactor may include, for each of the two impact rollers, first retaining means which is engagable with the impact roller and the shaft end and which prevents loss of the impact roller on failure of the stub axle.

Similarly the compactor may include, for each of the two impact rollers, second retaining means which is engageable with the impact roller and the respective stub axle means, thereby retaining the impact roller on the stub axle means.

To minimize the stresses on the axle means the junction between each impact roller and the axle means is placed near or close to the centre of gravity of the impact roller. Thus each impact roller may include a hub which is secured to the axle means, the hub means being located substantially in the plane containing the centre of gravity of the impact roller.

The hub may include a first member which is secured to the impact roller, a second member which is secured to the axle means, and shock absorbing means connecting the first and second members to each other. The shock absorbing means minimizes stresses which are transferred from the impact roller to the axle means.

The effectiveness of the compactor in compacting the edges of earth embankments may be improved through the use of a skirt means which is releasably secured to the outer side of one of the impact rollers. The skirt means has an embankment forming surface which extends outwardly and away from the impact surface of the impact roller.

The compactor may further include ground engaging wheels which are located between the impact rollers, the ground engaging wheels supporting a chassis which is drawn by a tractive device in the form of a tractor. When the tractor performs a sideways movement the axle means and impact rollers attached thereto also turn sideways with a yawing motion. The ground engaging wheels will, during this yawing motion, have a degree of sideways slip relatively to the ground surface, the degree of sideways slip being minimized when the wheels are placed in a position directly under the axle means which supports the pair of impact rollers.

The chassis which is supported by the ground engaging wheels forms a stable platform on to which the axle means, including springing and damping components which are part of the state of the art in impact roller design, may be mounted.

If the ground engaging wheels are made sufficiently strong, the whole axle means with attached impact rollers may be lifted and supported upon the chassis thereby enabling the whole machine to be towed on a highway.

Alternatively the axle means, may be fixed directly to a chassis drawn by the tractive device.

BRIEF DESCRIPTION OF THE DRAWINGS

The invention is further described with reference to the accompanying drawings in which.

DESCRIPTION OF PREFERRED EMBODIMENTS

Figure 1:
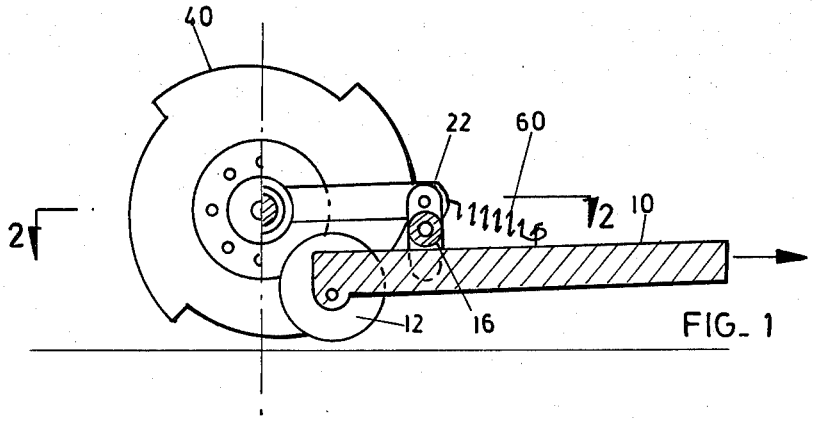
FIG. 1 is a schematic side view of a compactor.
Figure 2:
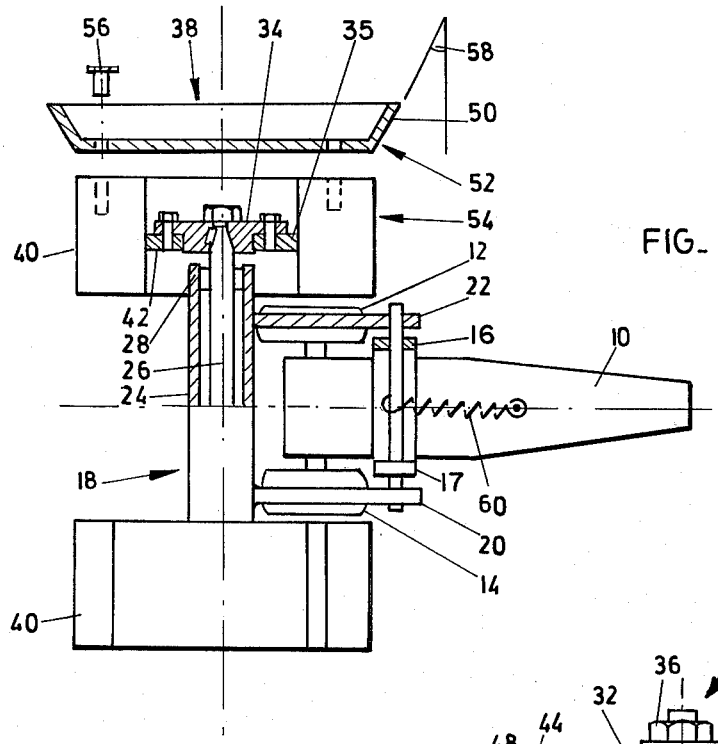
FIG. 2 is a plan view of the compactor of FIG. 1, partly sectioned.
Figure 3:
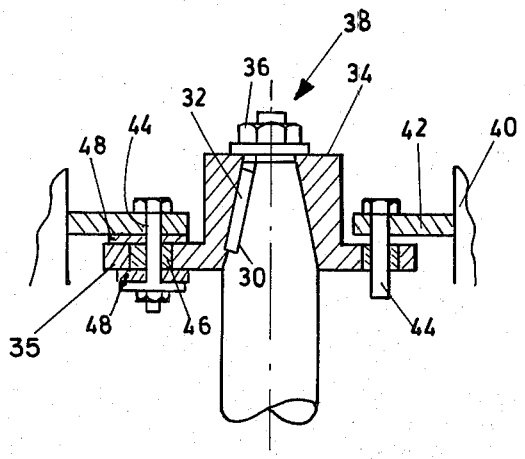
FIG. 3 is an enlarged view of an alternative form of a hub assembly for the compactor of FIGS. 1 and 2.

In FIGS. 1 to 3, a compactor includes a chassis 10 which has two ground engaging wheels 12 and 14 respectively and which at its forward end includes a device, not shown, whereby it may be coupled to a tractive device e.g. a tractor. The wheels 12 and 14 are of course not driven, and are rotatable independently of each other. They support the weight of the chassis 10.

A linkage system 16, 17, 20, 22 connects the chassis 10 to an axle mechanism 18. The axle means comprises a tube 24 to which the linkage members 22, 24 are attached, and a shaft 26 rotatably supported inside the tube 24 by means of bearings 28.

The opposed ends of the shaft 26 extend from the tube 24. Each shaft end is tapered and has a keyway 30 in which is engaged a key 32. The key in turn is engaged with a keyway in a hub 34 which is retained on the shaft end by means of a nut 36.

The hub 34 forms part of a hub mechanism, designated generally by the reference numeral 38, of an impact roller 40 which has four impact surfaces. The hub 34 has a first flange 35 which overlaps with a second flange 42 which is fixed to the impact roller 40 and which lies in the plane containing the centre of gravity of the impact roller 40. In FIG. 2 the two flanges are illustrated as being directly bolted to one another, whereas in the inventive embodiment shown in FIG. 3, the two flanges 35 and 42 are secured to each other by means of bolts 44 which pass through rubber grommets 46 and rubber washers 48.

In use traction is exerted on the compactor via the chassis 10. The traction is applied via the linkage system 16, 17, 20, 22. The linkages 16, 17 are so constructed as to be strong in torsion thereby enabling lateral steering forces to be transmitted to the linkages 20, 22 and thence to the axle tube 24, the shaft 26, and the impact rollers 40.

The shaft 26 constrains the impact rollers to rotate in unison i.e. in synchronism with one another. Bending forces which are exerted through the impact rollers on the shaft 26 during operation are reduced to a minimum in that the shaft is supported on the bearings 28 which are located close to the line of application of the impact force i.e. in the plane of the second flange 42. Bending forces on the shaft are also minimized in that the flange 42 is located in the plane of the centre of gravity of the impact roller 40 and consequently the mass of the roller does not in itself give rise to undue stresses in the shaft.

A further reduction in stresses is achieved by means of the resilient grommets 46 and washers 48 in the hub assembly 38. These grommets and washers permit a degree of resilient tilting of the plane of rotation of each impact roller relatively to the shaft (and consequently to the axle means), and so prevent excessive shock loads from being transmitted between the first flange 35 and the second flange 42 i.e. between the impact rollers and the axle means. The lateral spacing of the impact rollers 40 which is clearly evident from FIG. 2 means that the compaction zones on the surface on which the compactor is operated extend outside the path which is traversed by the tractive device. Consequently the rollers are able to compact the edges of earth embankments. The effectiveness of the compaction may be increased yet further by means of a compacting skirt 50 as illustrated in FIG. 2. The skirt 50 has a compacting i.e. embankment forming surface 52 which extends outwardly and away from the impact surface 54 of the impact roller 40. The skirt is releasably secured to the outer side of the impact roller by means of bolts 56. The surface 52 of the skirt forms an angle 58 with the horizontal which is the desired angle of slope of the embankment.

FIGS. 1 and 2 schematically illustrate a springing device 60 which interconnects the linkage system 16, 17, 20, 22 and the chassis 10. The Figures do not purport to show the type of springing device used in practice. The device 60 may be any suitable mechanism e.g. a spring combined with damping, and is used to create an elastic traction force while at the same time cushioning shock loadings arising in operation of the compactor between the axle means and the chassis 10.

Figure 4:
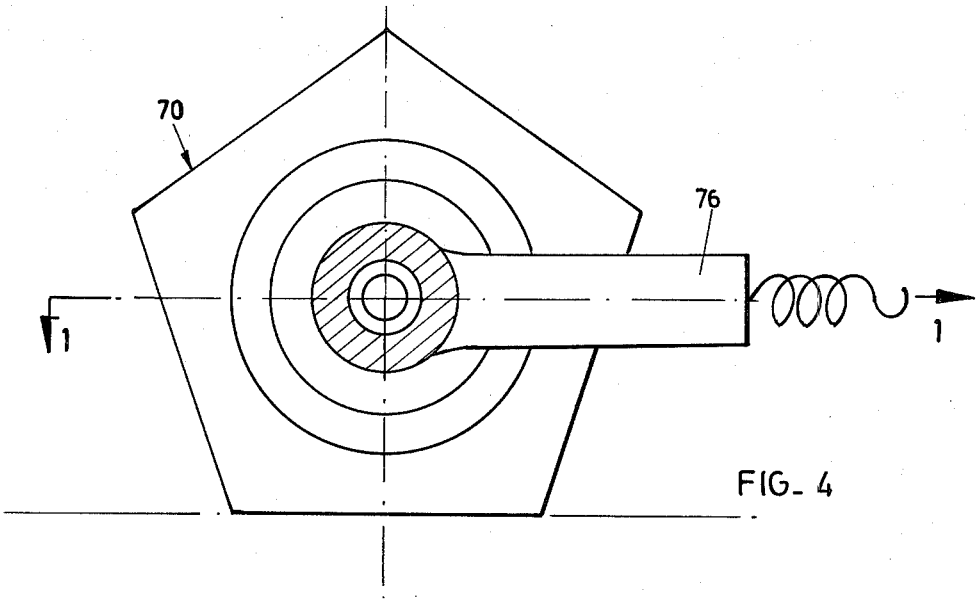
FIG. 4 is a schematic side view of a compactor.
Figure 5:
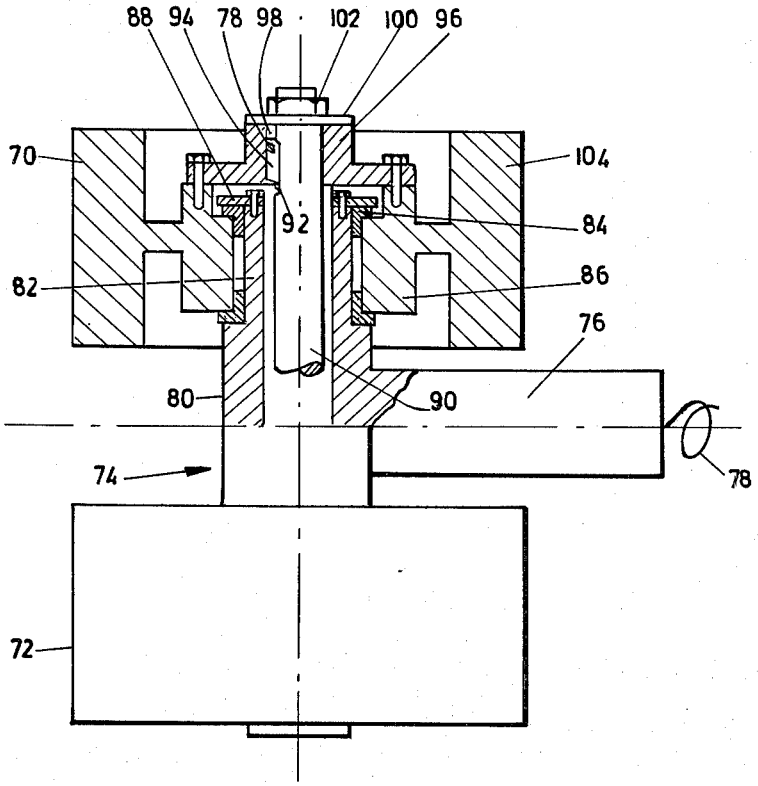
FIG. 5 is a partly sectioned plan view of the compactor of FIG. 4.

The embodiment of the compactor shown in FIGS. 4 and 5 is equally effective for use in compacting embankments but, as with the former compactor, this compactor's use is not restricted to applications of this type. The compactor includes two laterally separated five sided impact rollers 70 and 72 respectively which are rotatably supported on a chassis 74. A drawbar 76 which form part of the chassis 74 is used to apply tractive effort to the compactor. Use may be made of a springing mechanism 78, illustrated schematically in the drawings, to provide springing and damping of forces between the compactor and the tractor or other tractive device.

The chassis 74 in this embodiment includes a tubular member 80 the ends of which are stepped to form two stub axles 82. Each stub axle has bearings 84 which rotatably support a hub 86 of the respective impact roller 70. A retaining plate 88 is bolted to the end of the stub axle 82 and prevents the hub 86 from moving axially off the stub axle 82 A shaft 90 is located inside the tubular member 80. The shaft is freely rotatable relatively to the tubular member and its ends extend beyond the ends of the stub axle 82. Each shaft end has a keyway 92 in which is located a key 94. An outer flanged hub 96 which has a complementary keyway 98 is engaged with the key 94 and is bolted to the hub 86. The shaft end extends through the outer hub 96 and a retaining plate 100 is secured to the shaft end by means of a nut 102.

The design of the compactor is such that the tubular member 80 and the stub axles 82 can withstand the bending moments which are imposed on them by the movement of the two impact rollers 70 and 72. The tubular member 80 is not employed to enforce synchronous rotation of the impact rollers for, in the absence of the shaft 90, the impact rollers are rotatable on their respective stub axles independently of one another.

The shaft 90 is employed to transmit torsional forces between the impact rollers and to ensure that they rotate in synchronism. Since the shaft is secured by means of keys to each impact roller the only relative rotational movement permissible between the rollers is that offered by the torsional resilience of the shaft 90.

In this embodiment of the invention, in the former embodiment, the hub assembly of each impact roller is such that the roller is supported on the axle assembly substantially in the plane of its centre of gravity. Consequently bending stresses are minimized.

The retaining plates 88 and 100 respectively enhance the safety of the compactor. If the stub axle 82 should fail the retaining plate 100 maintains the coupling of the respective impact roller to the shaft and so prevents the impact roller from becoming detached from the axle means and proceeding on an uncontrolled path. On the other hand if the shaft 90 should fail the retaining plate 88 ensures that the respective impact roller is held captive on the axle means.

With the embodiment of the invention shown in FIGS. 4 and 5 use could again be made, instead of the chassis 74 of a wheeled chassis 10 of the type shown in FIGS. 1 and 2. Similarly, resilient bodies should be employed in the coupling between the hub 86 and the rim 104 of the impact roller 70 to permit limited movment of the impact rollers relatively to the axle means in response to bending forces. Clearly a skirt 50 of the type shown in FIG. 2 could be employed with the second embodiment of the invention.

In each embodiment of the invention a compactor is provided which is capable of compacting surface areas located outside the pathway travelled by a tractive vehicle. This feature makes the compactor particularly suitable for use in compacting the edges of embankments. Moreover because of the spacing of the impact rollers the compactor is inherently more stable and so is able to operate on steep sites.

I claim:

1. A compactor which comprises a chassis adapted to be drawn by tractive means, two laterally separated impact rollers of substantially identical non-circular profile, stub axle means operatively related to the chassis and supporting each impact roller for rotation, and torsion means connecting the impact rollers to each other to constrain the impact rollers to rotate substantially in synchronism with each other, but torsionally permitting a degree of out-of-synchronism movement in response to torsional forces.

2. A compactor according to claim 1 in which the torsion means temporarily permits the degree of out-of-synchronism movement and resiliently returns the impact rollers to their initial relative rotational positions when torsional forces cease.

3. A compactor according to claim 1 further comprising bearings on the stub axle means, each impact roller being rotatably supported on a respective one of the bearings, and in which the torsion means comprises a shaft which is rotatably located in bores of the stub axle means and which is secured at each end to one of the impact rollers.

4. A compactor according to claim 3 which includes for each of the two impact 40 rollers first retaining means which is engageable with the impact roller and the respective shaft end and which prevents detachment of the impact roller from the compactor on breakage of the respective stub axle.

5. A compactor according to claim 3 which includes for each of the two impact 40 rollers second retaining means which is engagable with the impact 40 roller and the respective stub axle 26 thereby retaining the impact 40 roller on the stub axle.

6. A compactor according to claim 1 wherein each impact roller includes a hub 38 which is secured to the axle 26 means, the hub 38 means being located substantially in the plane containing the centre of gravity of the impact roller.

7. A compactor according to claim 1 which includes skirt means which is releasably secured to the outer side of one of the impact rollers, the skirt 50 means having an embankment forming surface which extends slopingly away from the impact surface of the impact roller.

8. A compactor according to claim 1 which includes ground engaging wheels mounted on the chassis and located between the impact rollers.

9. A compactor which comprises a chassis adapted to be drawn by tractive means, two laterally separated impact rollers of substantially identical non-circular profile, axle means operatively related to the chassis and supporting each impact roller for rotation, constraining means connecting the impact rollers to each other to constrain the impact rollers to rotate substantially in synchronism with each other, but resiliently permitting a degree of out-of-synchronism movement in response to torsional forces and resilient means interposed between each impact roller and the axle means resiliently permitting a degree of tilting movement of the plane of rotation of each impact roller relatively to the axle means on which it is supported in response to bending forces.

10. A compactor according to claim 9 in which the resilient means is spaced a substantial distance radially outwardly from the axis of the impact roller.

11. A compactor according to claim 10 in which each impact roller has a flange which is secured by a series of bolts to an overlapping flange on the axle means, and the resilient means comprises a series of resilient grommets each surrounding such a bolt and a series of resilient bodies located between the flanges.

12. A compactor which comprises a chassis adapted to be drawn by tractive means, two laterally separated impact rollers of substantially identical noncircular profile, axle means operatively related to said chassis and supporting each impact roller for rotation, torsion means connecting the impact rollers to each other to constrain the impact rollers to rotate substantially in synchronism with each other, but torsionally permitting a degree of out-of-synchronism movement in response to torsional forces and resilient means interposed between each impact roller and the axle means resiliently permitting a degree of tilting movement of the plane of rotation of each impact roller relatively to the axle means on which it is supported in response to bending forces.

13. A compactor according to claim 12 in which the resilient means is spaced a substantial distance radially outwardly from the axis of the impact roller.

14. A compactor according to claim 13 in which each impact roller has a flange which is secured by a series of bolts to an overlappong flange on the axle means, and the resilient means comprises a series of resilient grommets each surrounding such a bolt and a series of resilient bodies located between the flanges.

* * * * *